US007703723B1

(12) United States Patent
Cooper et al.

(10) Patent No.: US 7,703,723 B1
(45) Date of Patent: Apr. 27, 2010

(54) BAG SUPPORT DEVICE

(76) Inventors: Charles Cooper, 1733 S. Chaparell Dr., Toquerville, UT (US) 84774; Douglas T. Cooper, P.O. Box 1675, Gardnerville, NV (US) 89410

( * ) Notice: Subject to any disclaimer, the term of this patent is extended or adjusted under 35 U.S.C. 154(b) by 0 days.

(21) Appl. No.: 12/075,258

(22) Filed: Mar. 10, 2008

Related U.S. Application Data

(60) Provisional application No. 60/906,063, filed on Mar. 9, 2007.

(51) Int. Cl.
*A63B 55/04* (2006.01)

(52) U.S. Cl. ..... 248/97; 248/99

(58) Field of Classification Search ..... 248/97, 248/95, 99, 100, 101; 220/495.08
See application file for complete search history.

(56) References Cited

U.S. PATENT DOCUMENTS 1,414,575 A * 5/1922 McCart ..... 248/97
4,488,697 A * 12/1984 Garvey ..... 248/101
4,664,348 A * 5/1987 Corsaut et al. ..... 248/99
4,899,967 A * 2/1990 Johnson ..... 248/97
5,397,085 A * 3/1995 Spagnolo ..... 248/97
5,913,496 A * 6/1999 Valdez ..... 248/99
6,416,023 B1 * 7/2002 Satsky ..... 248/99
2005/0006536 A1 * 1/2005 Yang et al. ..... 248/99
2005/0151033 A1 * 7/2005 Folkmar ..... 248/95
2005/0199767 A1 * 9/2005 Gilbert ..... 248/97
2009/0046955 A1 * 2/2009 Schember et al. ..... 383/33

* cited by examiner

*Primary Examiner*—Ramon O Ramirez
(74) *Attorney, Agent, or Firm*—Jones Waldo Holbrook & McDonough, PC

(57) ABSTRACT

A bag support device comprising an inner ring, having a locking flap, with a locking button extending therefrom; and one or more leg sockets. The device also includes an outer ring defining a space that is adapted to receive the inner ring, and having a locking hole, corresponding to the locking button; a tapered edge; and one or more convexities, corresponding to the one or more leg sockets. One or more legs are coupled to the inner ring at the leg sockets; and a bag support member is coupled to the outer ring through a support member socket. A handle is coupled to the outer ring.

14 Claims, 13 Drawing Sheets

BAG SUPPORT DEVICE

PRIORITY STATEMENT

This application claims priority to U.S. Provisional Patent Application No. 60/906,063, filed Mar. 9, 2007, which is hereby incorporated by reference.

BACKGROUND

As can verified by anyone that has ever attempted to place raked leaves, lawn clippings, piles of garbage, etc. into a trash bag, it is virtually impossible for a single person to successfully do so without 1) employing another person to hold open the bag; or 2) utilizing some type of large receptacle in which the bag is placed. Often, and especially for those that live alone, employing another person to hold open the bag is not a possibility. Use of a garbage can or other similar receptacle is also often not the best fit. For example, many garbage receptacles are large and heavy, and add significant weight that must be lugged around by the user. This also makes storage of the devices difficult and inefficient in terms of space—which can be especially important when one is using the receptacle while traveling, picnicking or camping.

Additionally, in order to place items into a typical garbage can, one must use a dustpan (or something that functions as a dustpan), or his hands in bringing the items from the pile into the receptacle. The garbage receptacle could potentially be laid on its side to prevent such handling of the trash. However, typically garbage cans are rounded and thus not well suited for lying on their sides. Additionally, such cans do not have an edge that allows for easy sweeping of the material into the can.

All of the foregoing shortcomings in the current state of the art, as well as many others, are addressed by the present invention in its various embodiments.

SUMMARY OF THE INVENTION

The invention as presently claimed is for a bag support device. The device in its various embodiments can include an inner ring, having a locking flap, with a locking button extending therefrom; and one or more leg sockets. It also includes an outer ring that defines a space that is adapted to receive the inner ring. The outer ring has a locking hole, corresponding to the locking button; a tapered edge; and one or more convexities, corresponding to the one or more leg sockets. One or more legs are coupled to the inner ring at the leg sockets; and a bag support member is coupled to the outer ring through a support member socket. In some embodiments, a handle coupled to the outer ring. The rings can be a variety of shapes including, but not limited to, substantially semi-circular, substantially triangular and substantially rectangular. In certain embodiments, the legs are removably coupled to the inner ring; as is the support member.

DETAILED DESCRIPTION OF THE DRAWINGS

Figure 1:
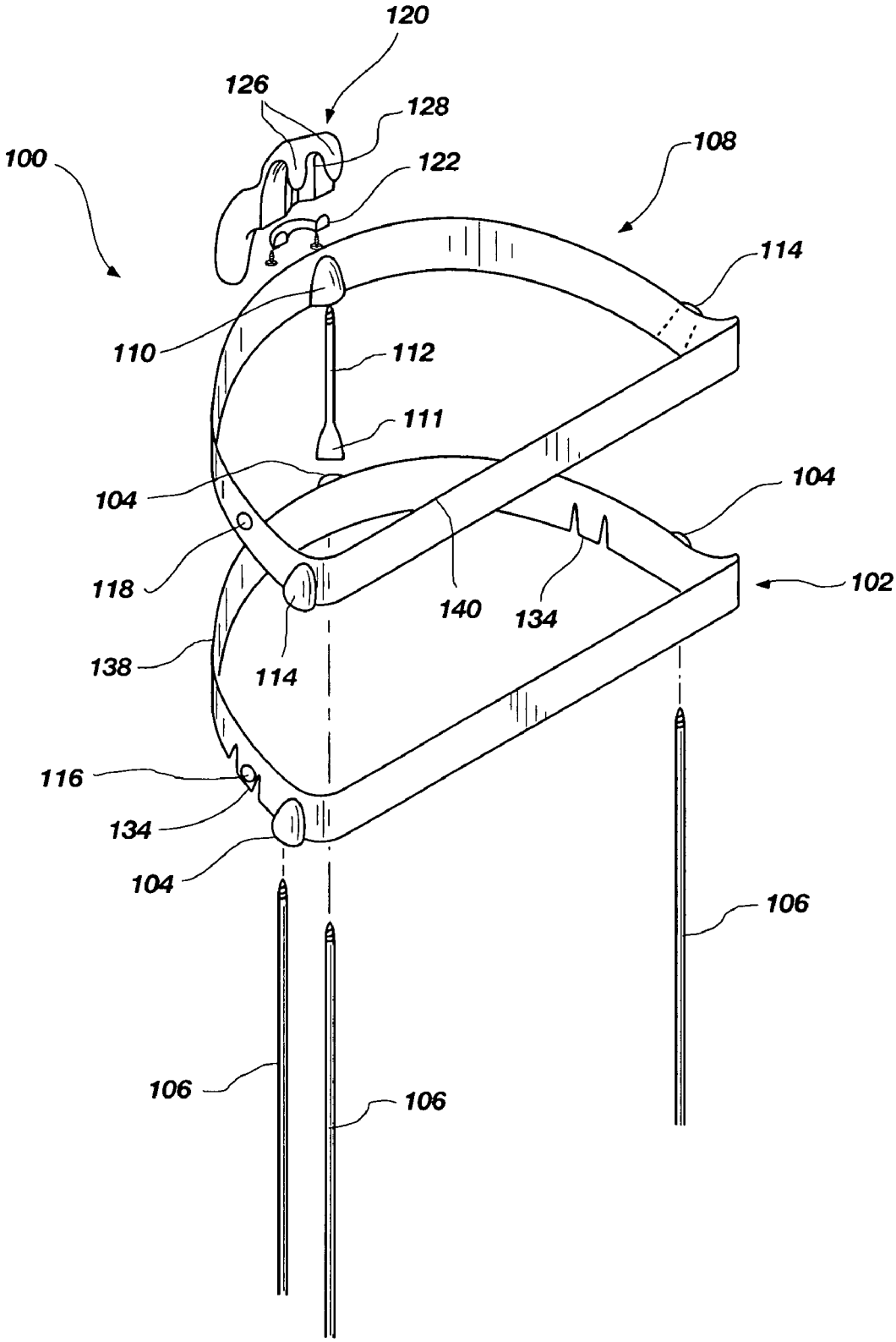
FIG. 1 shows a broken view of a bag support device according to one embodiment of the present invention.

The following detailed description, and accompanying drawings, is intended to provide only exemplary embodiments of the invention and the manner in which the invention may be practiced. While these exemplary embodiments are described in sufficient detail to enable those skilled in the art to practice the invention, it should be understood that other embodiments may be realized and that various changes to the invention may be made without departing from its spirit and scope. Thus, the following more detailed description of the embodiments of the present invention, as represented in FIGS. 1 through 19, is not intended to limit the scope of the invention as claimed.

Referring to FIGS. 1-7, there is shown a bag support device 100 according to one embodiment of the present invention. The device 100 includes an inner loop or ring 102 and a corresponding outer loop or ring 108. It is noted that the term "ring" and "loop" as used to describe the inner loop 102 and outer loop 108 is intended to include a variety of shapes and configurations including, but not limited to, semi-circular, rectangular, square, triangular, as well as any number of suitable configurations that would be apparent to one skilled in the art.

As described further below, the inner loop 102 and outer loop 108 correspond such that the inner loop 102 is adapted to fit into a space 142 (FIGS. 10-12) defined by the outer loop 108, as the outer loop 108 is placed over the inner loop 102. The inner loop 102 includes leg sockets 104 into which legs 106 are placed. In this embodiment, the legs 106 include a tapered end 107 that provides for a snug fit in the socket 104. However, it is noted that many other possible configurations would be suitable for attaching the legs. For example, the top end of the legs 106 and sockets 104 may have corresponding threading. Numerous other attaching mechanisms for the legs would be apparent to those skilled in the art. However, it is noted that in some instances, relatively easy removal of the legs may be desirable (e.g. to improve portability of the device). In such an embodiment, a friction or other threadless connection, or a twist-lock connection would be the preferred method of attachment. The legs 106 in this embodiment are sturdy, but flexible rods made of fiberglass. However, other materials could be used for the legs 106 including, but not limited to, steel, wood, and plastic.

It is also noted that as used herein, the term "socket" is intended to include any conventional male/female mechanisms for securing a leg. For example, in some embodiments, the socket would simply be an invisible hole in the inner loop 102 (i.e. without any external bulge). The practicability of such a socket would depend on the thickness of the inner loop 102 (i.e. if it was thick enough to accommodate such a hole). Clearly, in such an embodiment, there would not need to be any corresponding convexities in the outer loop 108. It is also noted that in some embodiments, the socket could be on the top end of the leg (and the inner loop could include a tapered end, or some other mechanism that could be inserted into the leg socket).

Figure 15:
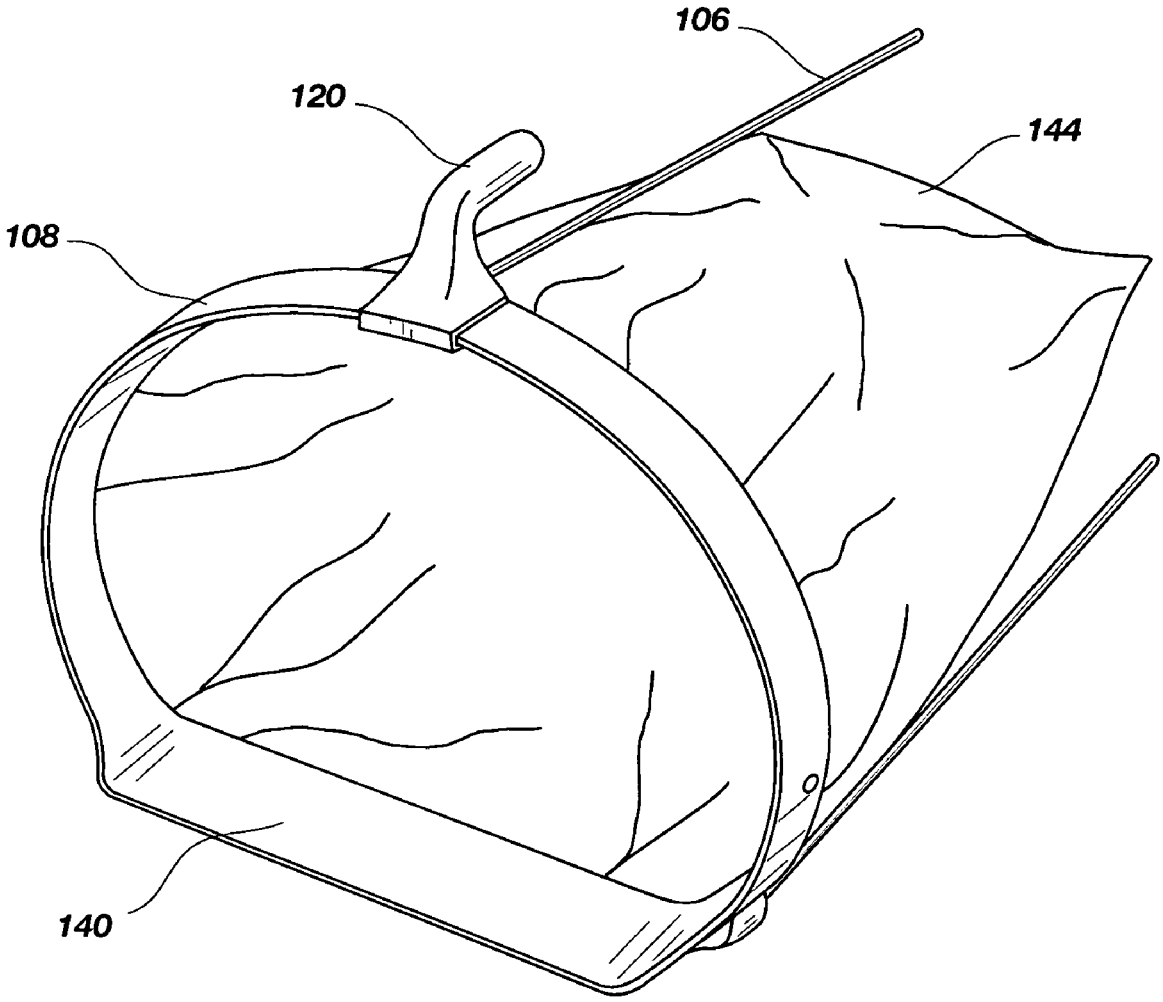
FIG. 15 shows yet another embodiment of a bag support device.
Figure 16:
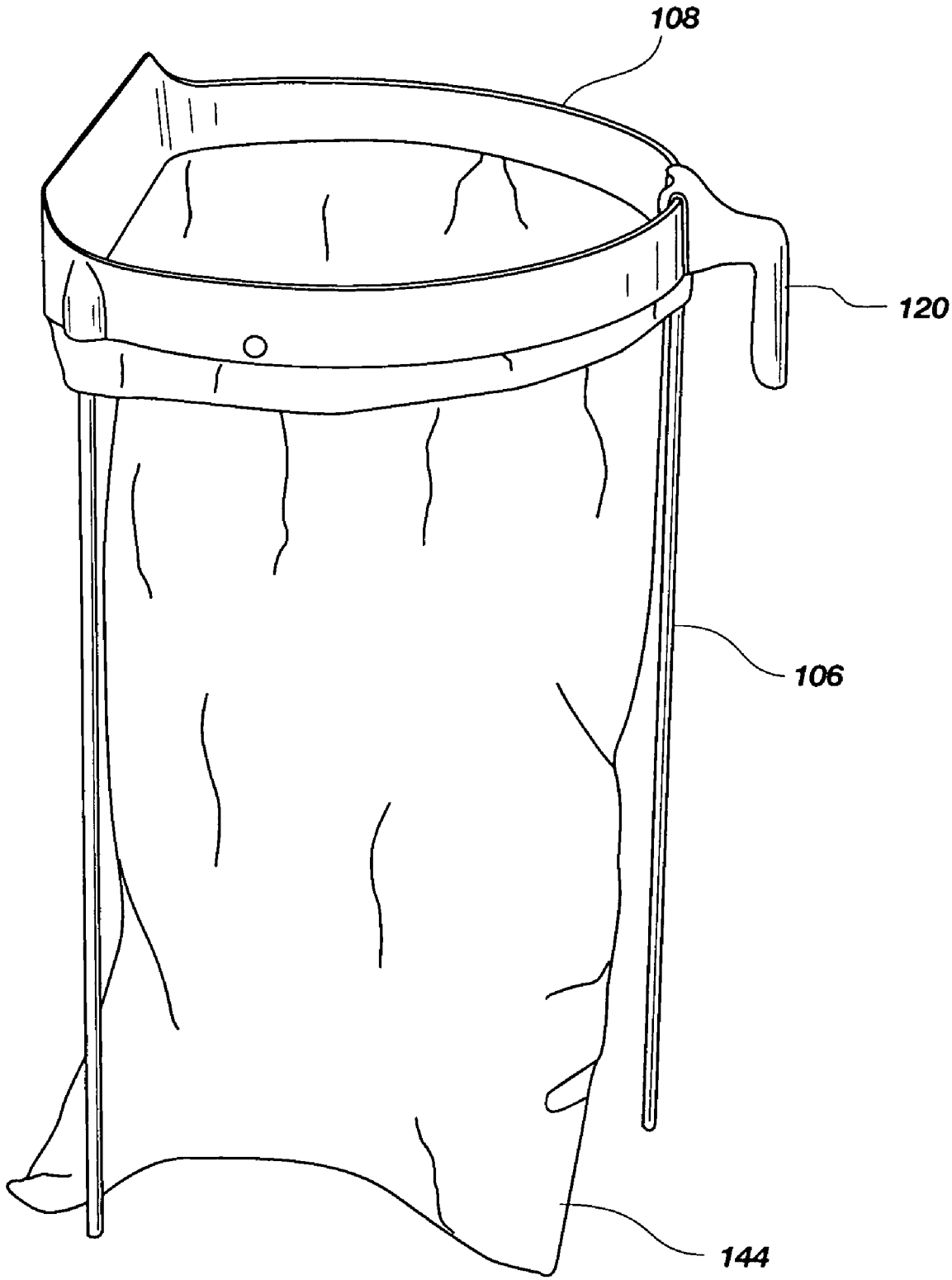
FIG. 16 shows a side view of the device in FIG. 15 in an upright position.
Figure 17:
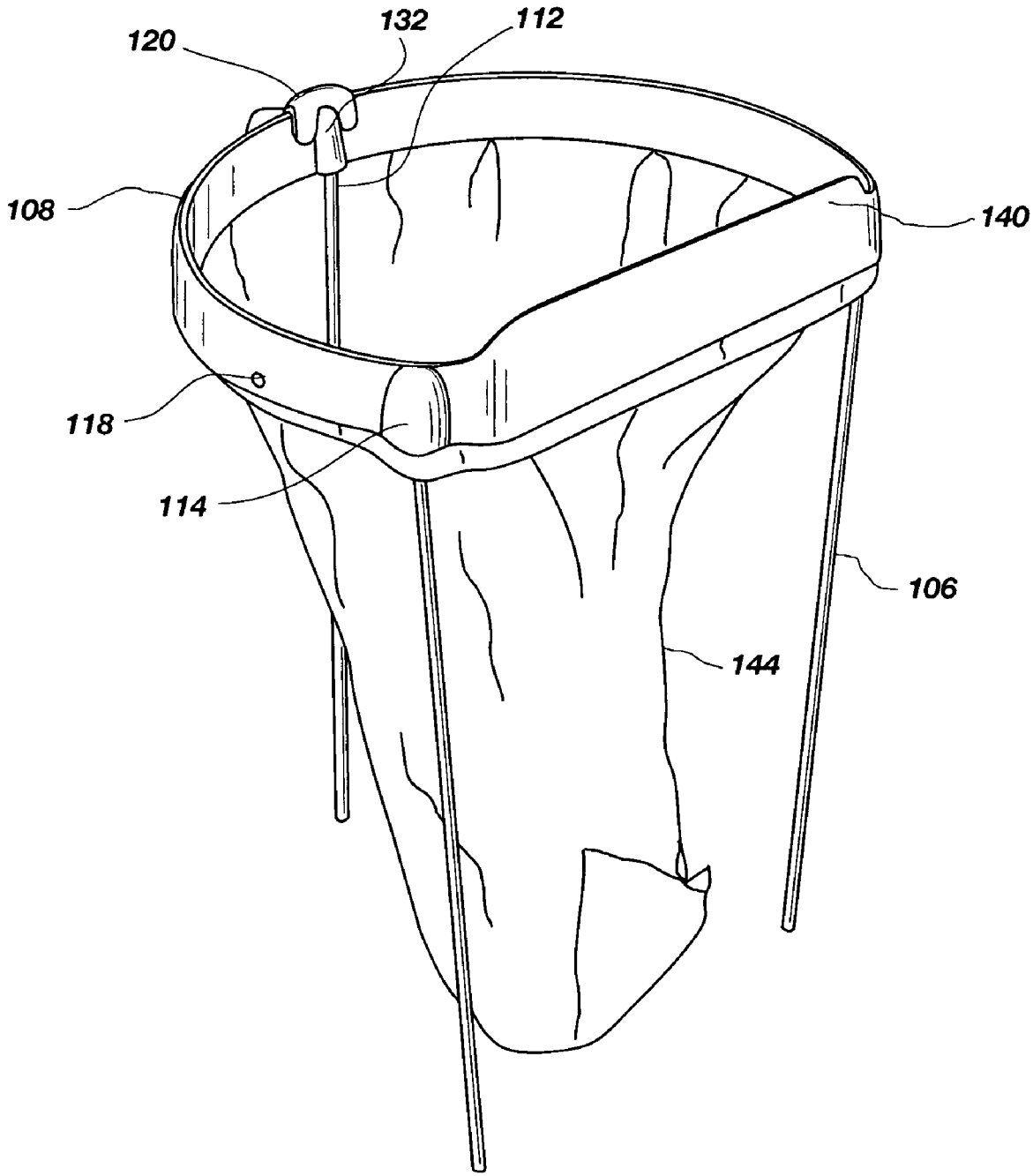
FIG. 17 shows a rear perspective of the device in FIG. 15 in an upright position.

The support device 100 also can include a support member 112. This support member 112 in this embodiment is made of plastic. However, other materials could be used for the support member 112 including, but not limited to, steel, wood, and fiberglass. The support member 112 is coupled to outer loop 108 through socket 110. The support member 112 can also include a flattened end 111 to further assist in supporting the bag 144 (FIGS. 15-17). It is noted that the length of the support member 112 can vary depending on a variety of factors, such as the length of the bag 144, the level of support desired, etc.

Similar to the legs 106, the support member 112 can include a tapered end 113 by which it is fastened into the socket 110. Many other possible configurations would be suitable for attaching the support member 112. For example, the top end 113 and socket 110 may have corresponding threading. Numerous other attaching mechanisms for the support member 112 would be apparent to those skilled in the art. However, it is noted that in some instances, relatively easy removal of the support 112 may be desirable (e.g. to improve portability of the device). In such an embodiment, a friction or other threadless connection, or a twist-lock connection would be the preferred method of attachment. It is also noted that the term "socket" as used in connection with the support member, is also intended to include any conventional male/female mechanisms for securing a leg—including invisible sockets and the socket being on the support member itself.

As noted above, the outer loop 108 fits around the inner loop 102. To accommodate the leg sockets 104, the outer loop 108 can also include one or more corresponding convexities 114. The inner loop 102 also includes a locking flap 135 that has a release button 116 extending therefrom. When the inner loop 102 is inserted into the outer loop 108, the locking flap 135 and release button 116 are slightly depressed. When the inner loop 102 is fully inserted, the locking flap 135 resumes its original position and the release button 116 fits into the lock hole 118.

Figure 2:
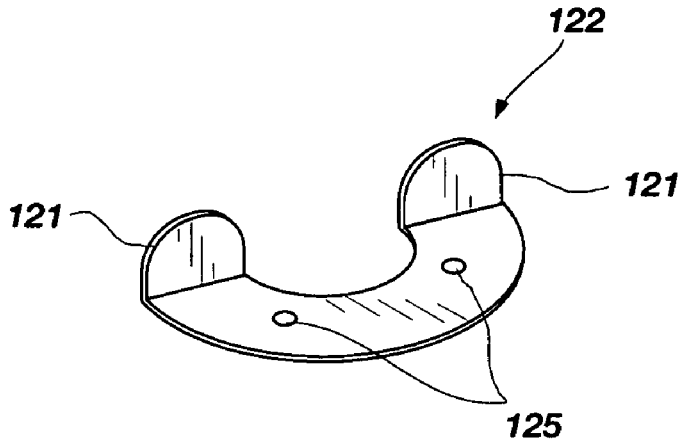
FIG. 2 shows a handle retaining device according to one embodiment of the present invention.
Figure 3:
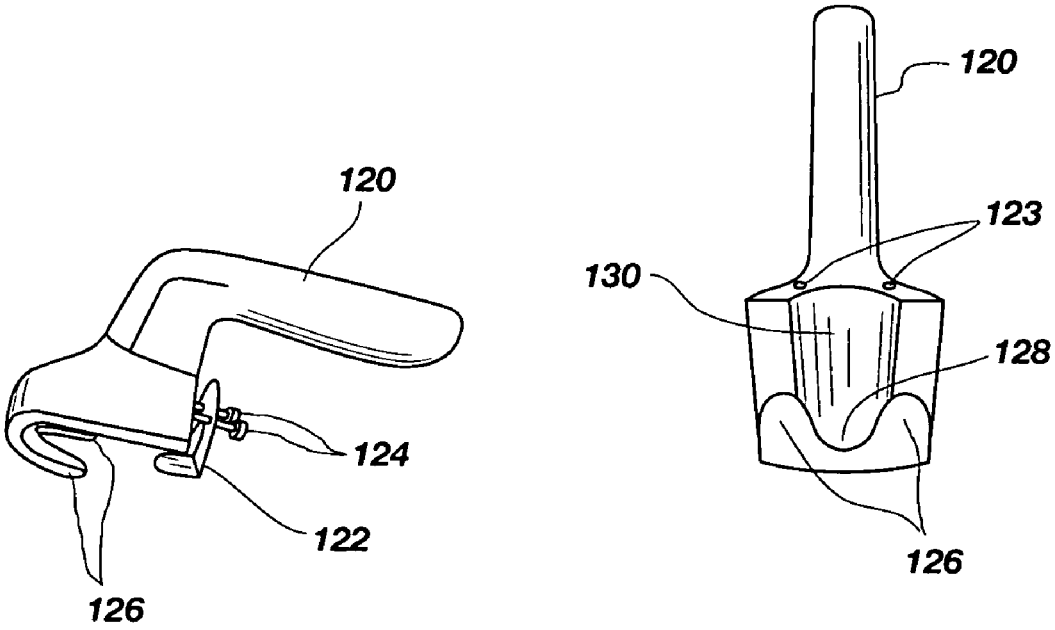
FIG. 3 shows two views of the handle shown in FIG. 1.
Figure 4:
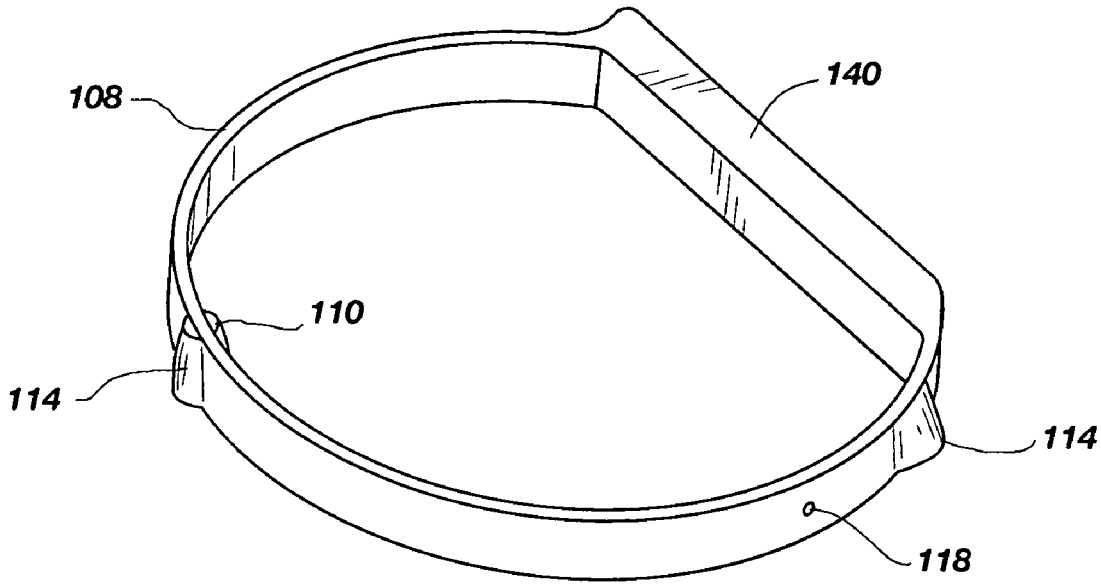
FIG. 4 shows the outer loop of the bag support device shown in FIG. 1.
Figure 5:
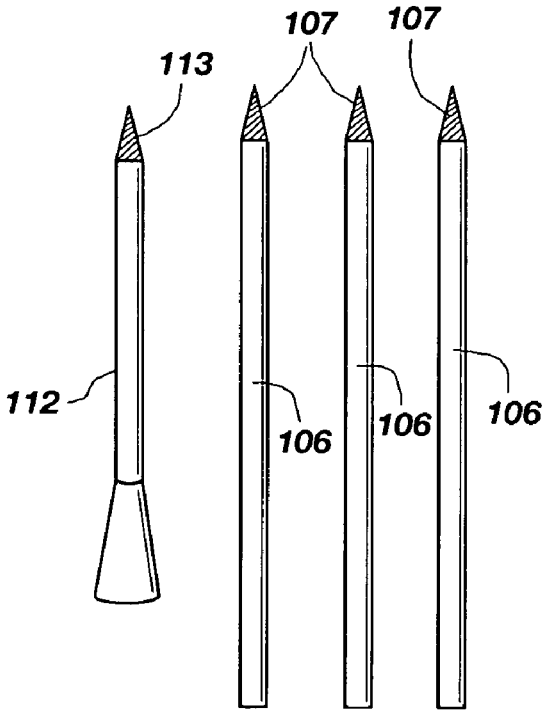
FIG. 5 shows the legs and support piece of the bag support device shown in FIG. 1.
Figure 6:
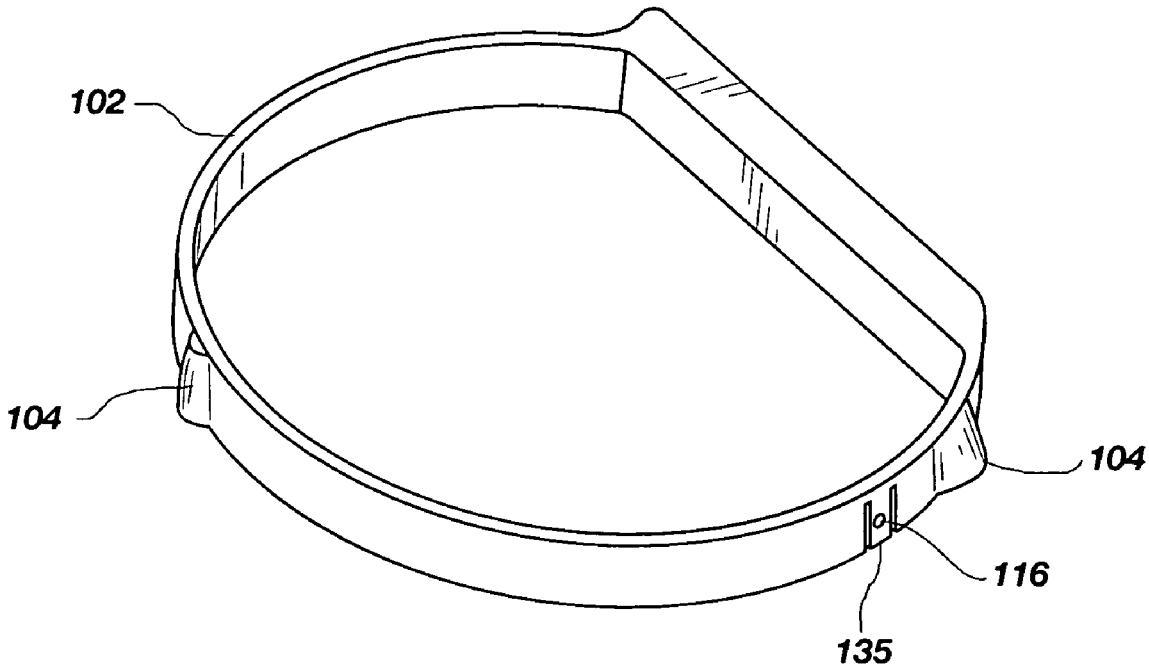
FIG. 6 shows the inner loop of the bag support device shown in FIG. 1.
Figure 7:
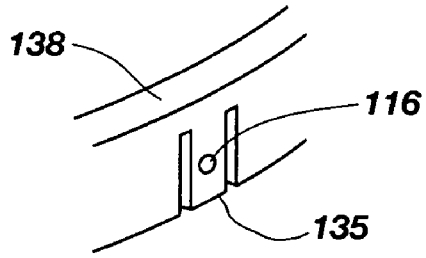
FIG. 7 shows a close-up view of the lock release button and the locking flap.

In certain embodiments, the support device can include a handle 120. As best seen in FIGS. 1-3, the handle 120 includes fingers 126—which serve to secure the handle 120 to the outer loop 168. Specifically, when the handle is attached, the fingers 126 slip down over the support member socket 110, such that it nestles into gap 128. In this embodiment, the handle 120 also includes a groove 130 that corresponds to the convexity 114.

The handle 120 can be further secured to the outer loop 108 by means of a bracket 122. The bracket 122 in this embodiment is fastened to the handle 120 by screws 124 threaded through corresponding holes 125, 123 on the bracket 122 and handle 120 respectively. As seen in FIG. 2, the bracket 122 includes bends 121 that, when attached, slip into the space 142 defined by the outer loop 108 helping to secure the handle 120 to the device 100. Thus, in operation, if a handle 120 is desired, the user would slip the handle 120 over the outer loop 108, aligning the gap 128 with the socket 110, and engaging the fingers 126. Next, the user would attach the bracket 122 to the handle 120 with screws 124. This also allows for easy removal of the handle (in situations where a handle may not be wanted) by simply removing the screws 124; removing the bracket 122; and then sliding the handle 120 off the outer loop 108 by disengaging the fingers 126.

As noted above, one advantage to the present invention is the inclusion of the tapered edge 140 on the outer hoop 108. The tapered edge 140 allows a user to lay the support device 100 on its side and more effectively sweep or rake (or otherwise direct) the leaves, garbage, etc. into the bag 144.

Figure 8:
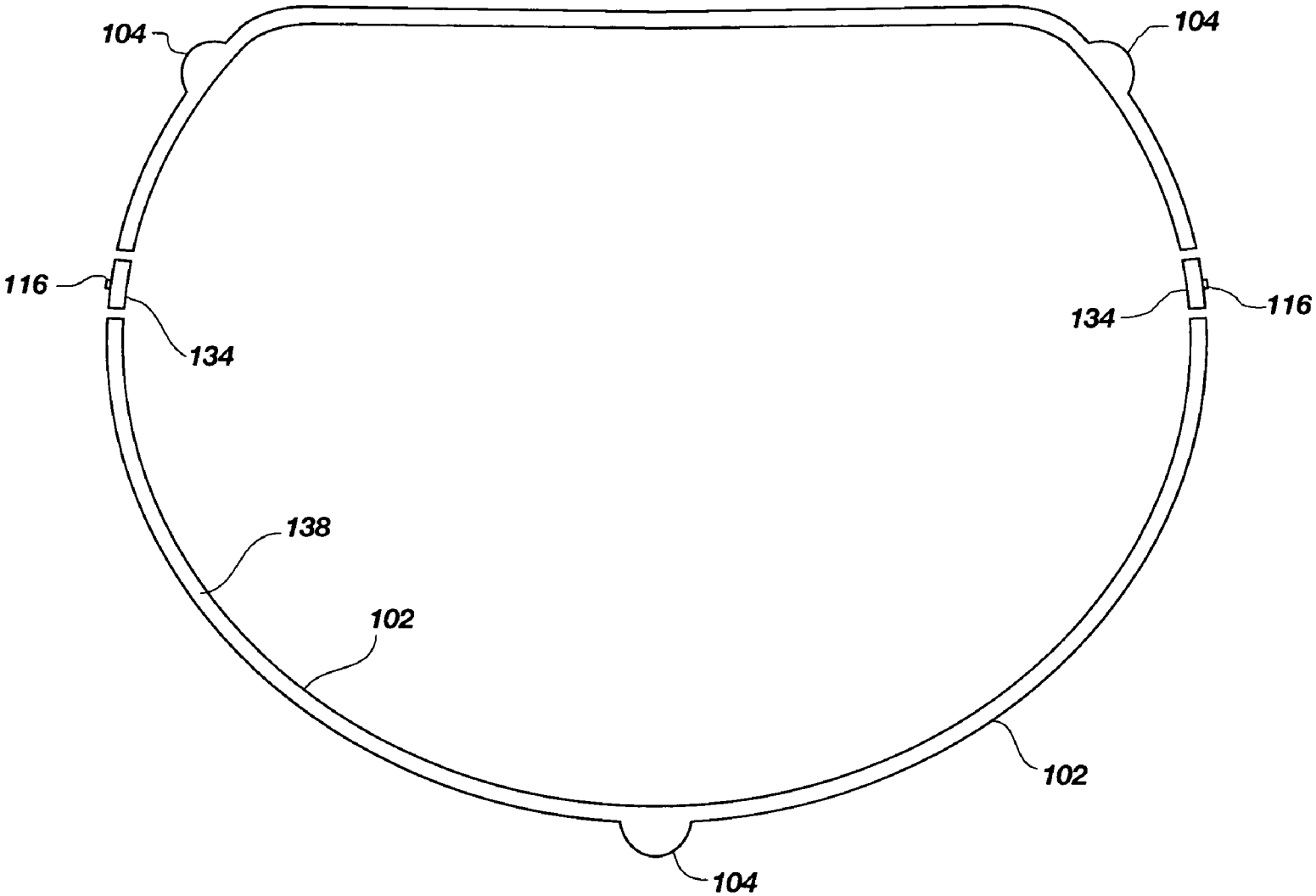
FIG. 8 shows a top-view footprint of the inner loop according to one embodiment of the present invention.

FIG. 8 shows a top-view footprint of the inner loop according to one embodiment of the present invention.

Figure 9:
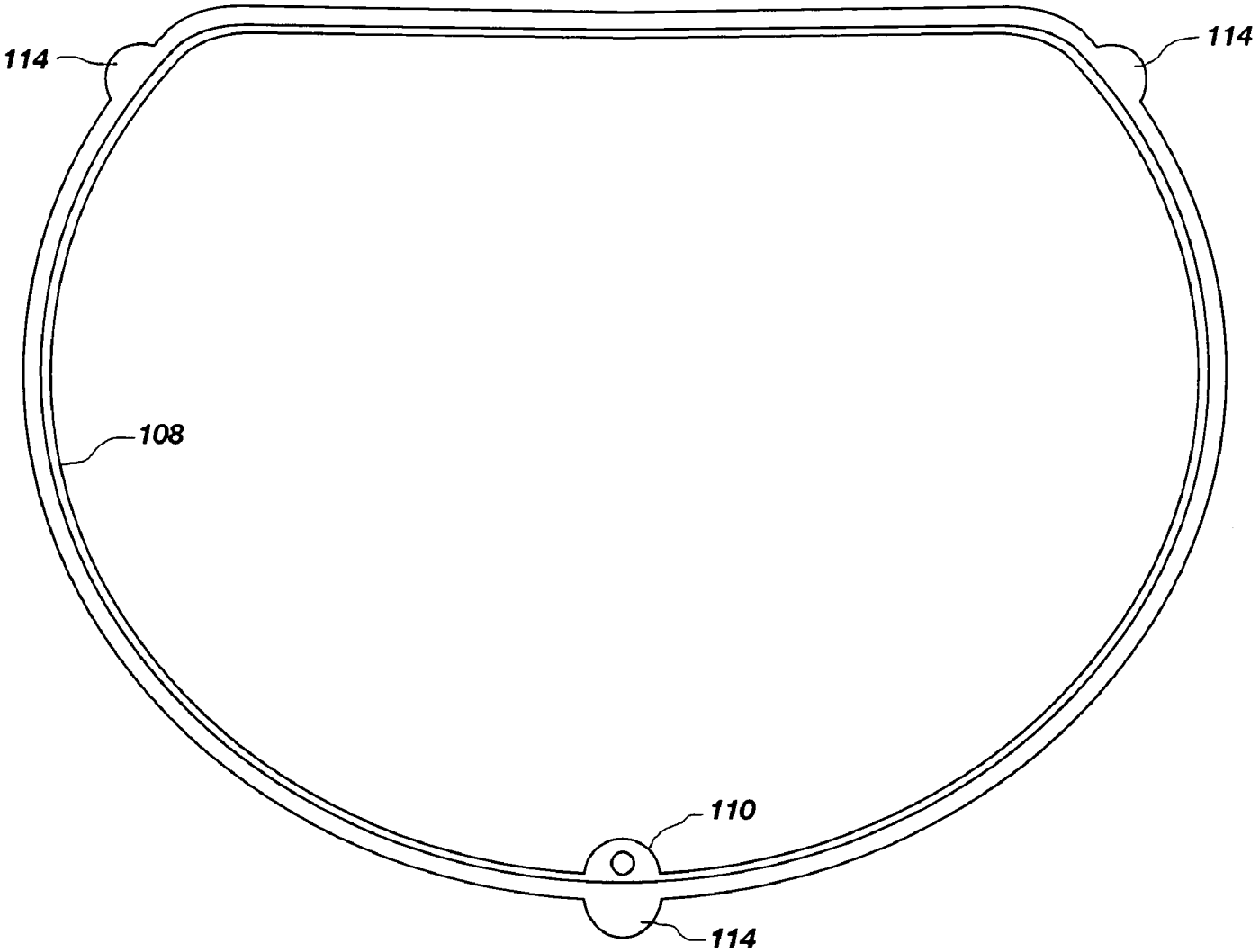
FIG. 9 shows a top-view footprint of the outer loop according to one embodiment of the present invention.

FIG. 9 shows a top-view footprint of the outer loop according to one embodiment of the present invention.

Figure 10:
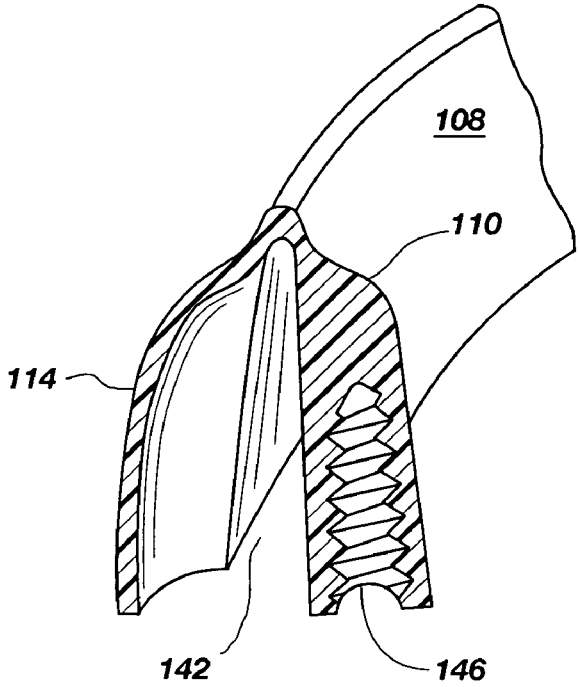
FIG. 10 shows a cross-sectional view of a bag support piece socket according to one embodiment of the present invention.
Figure 11:
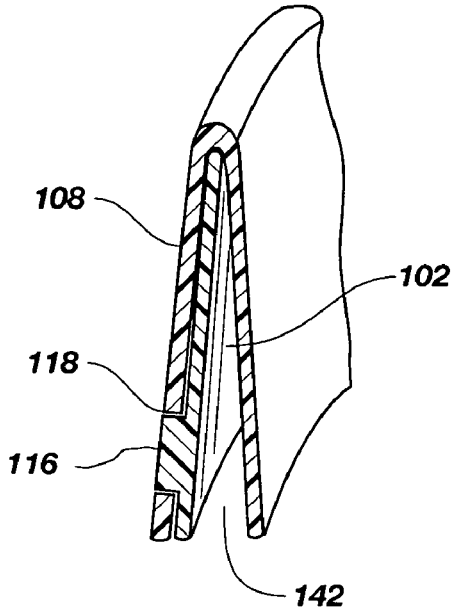
FIG. 11 shows a cross-sectional view of a lock release mechanism according to one embodiment of the present invention.
Figure 12:
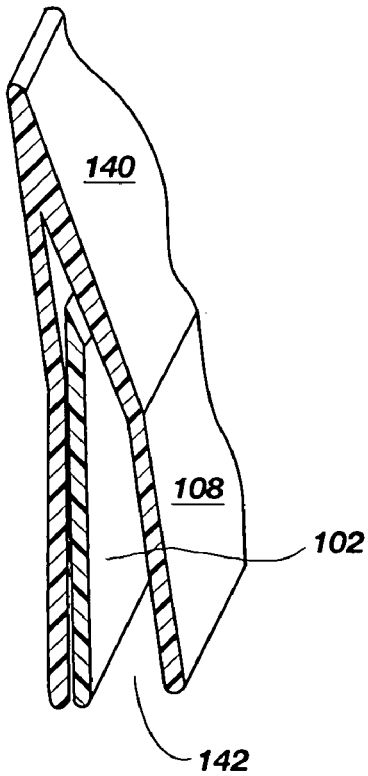
FIG. 12 shows a cross-sectional view of the tapered edge of the outer loop according to one embodiment of the present invention.

As better seen in FIGS. 10-12, inside the outer loop 108 is a space 142 into which the inner loop 102 fits. Referring to FIG. 10, a cross-sectional view of both the support member socket 110 and the convexity 114 is shown. A threaded hole 146 in which support piece 112 is placed is also shown.

It is noted that in the present embodiment, the space 142 into which the inner loop 102 is inserted runs substantially contiguously with the diameter of the outer loop 108. However, in other embodiments, the inner loop 102 may only partially engage with the outer loop 108. In such embodiments, a smaller space 142 could be employed (e.g. there could be sporadic openings in the bottom surface of the outer loop 108 that correspond with interlocking protrusions in the inner loop 102). Numerous other engaging mechanisms that would be apparent to one skilled in the art could also be utilized in various embodiments of the present invention.

Figure 14:
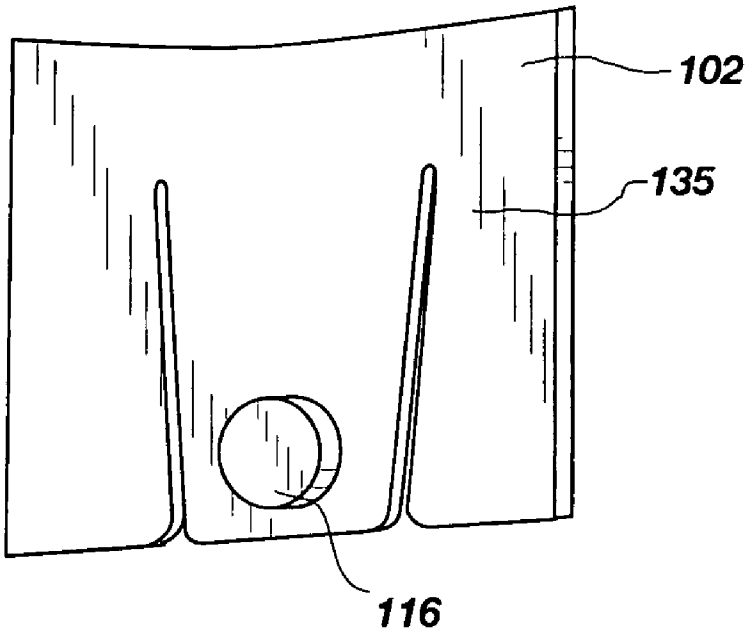
FIG. 14 shows a close-up view of the locking mechanism on the inner loop according to one embodiment of the present invention.
Figure 13:
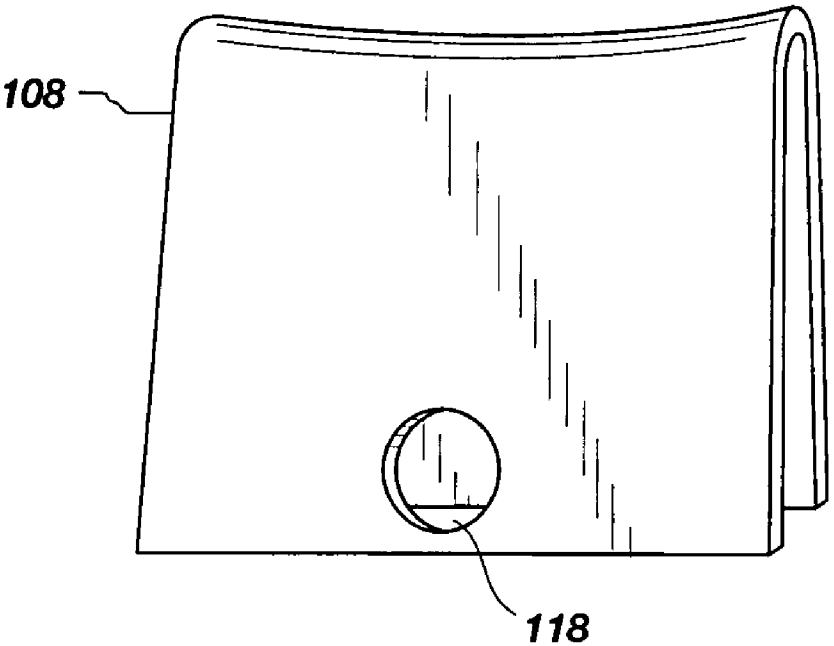
FIG. 13 shows a close-up view of the locking mechanism on the outer loop according to one embodiment of the present invention.

FIGS. 13-14 show a close-up view of the locking mechanism—i.e. the locking flap 135 with the locking button 116, and the corresponding locking hole 118.

FIGS. 15-17 show one embodiment of the present invention in operation, including an attached bag 144.

Figure 18:
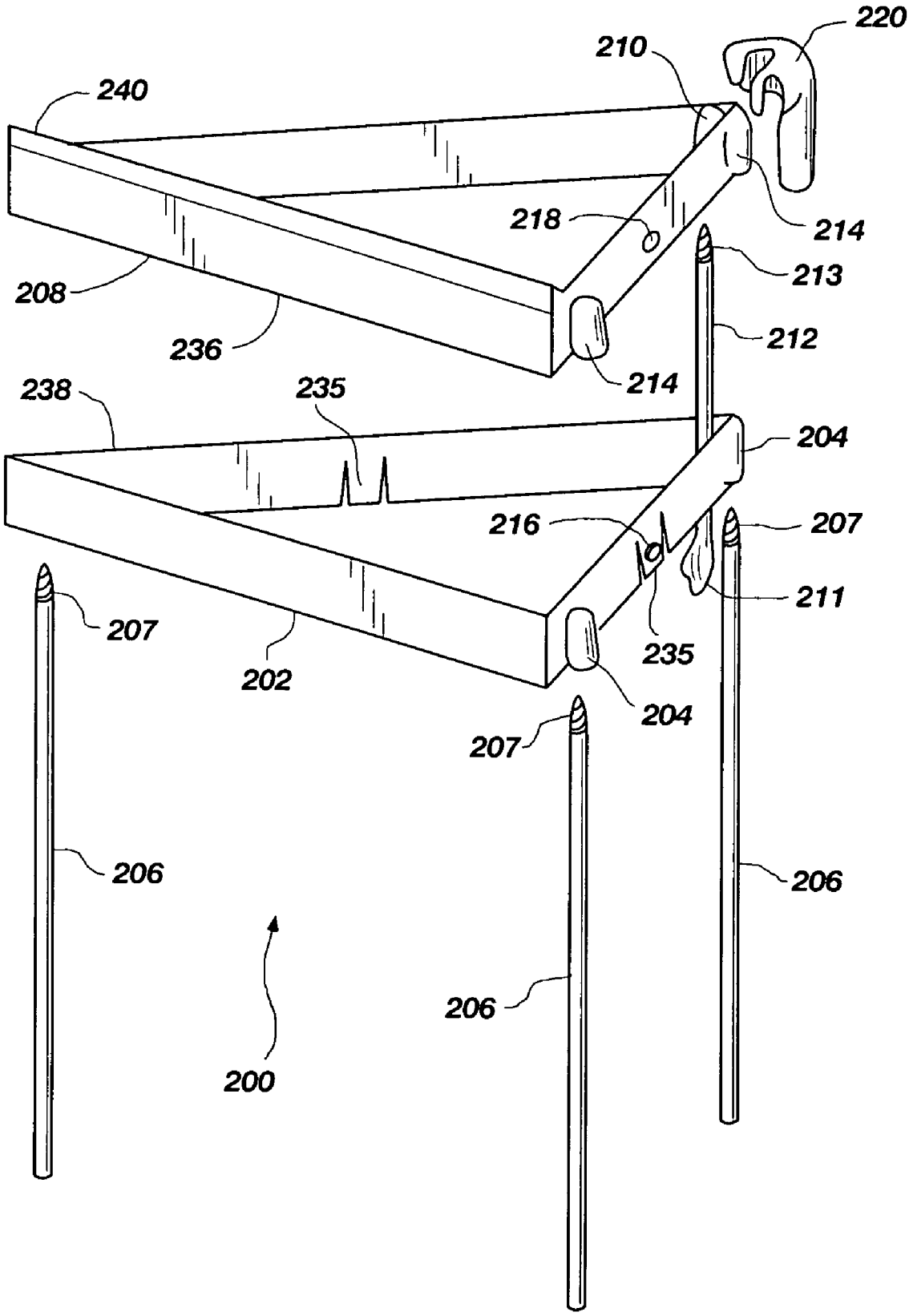
FIG. 18 shows a broken view of yet another embodiment of a bag support device.

FIG. 18 shows another embodiment of a bag support device 200. Functionally, it is very similar to those embodiments described above. The device 200 includes an inner ring 202 having leg sockets that are adapted to receive the top ends 207 of the legs 206. The outer ring 208 includes a support member socket 210 configured to receive the top end 213 of bag support member 212—which can also include a widened end 211.

This embodiment also includes convexities 214 that correspond to sockets 204. It likewise includes a locking mechanism having a locking flap 235, a release button 216, and a locking hole 218.

A handle 220 can also be included. This embodiment can also include a tapered edge 240 on the outer loop 208.

Figure 19:
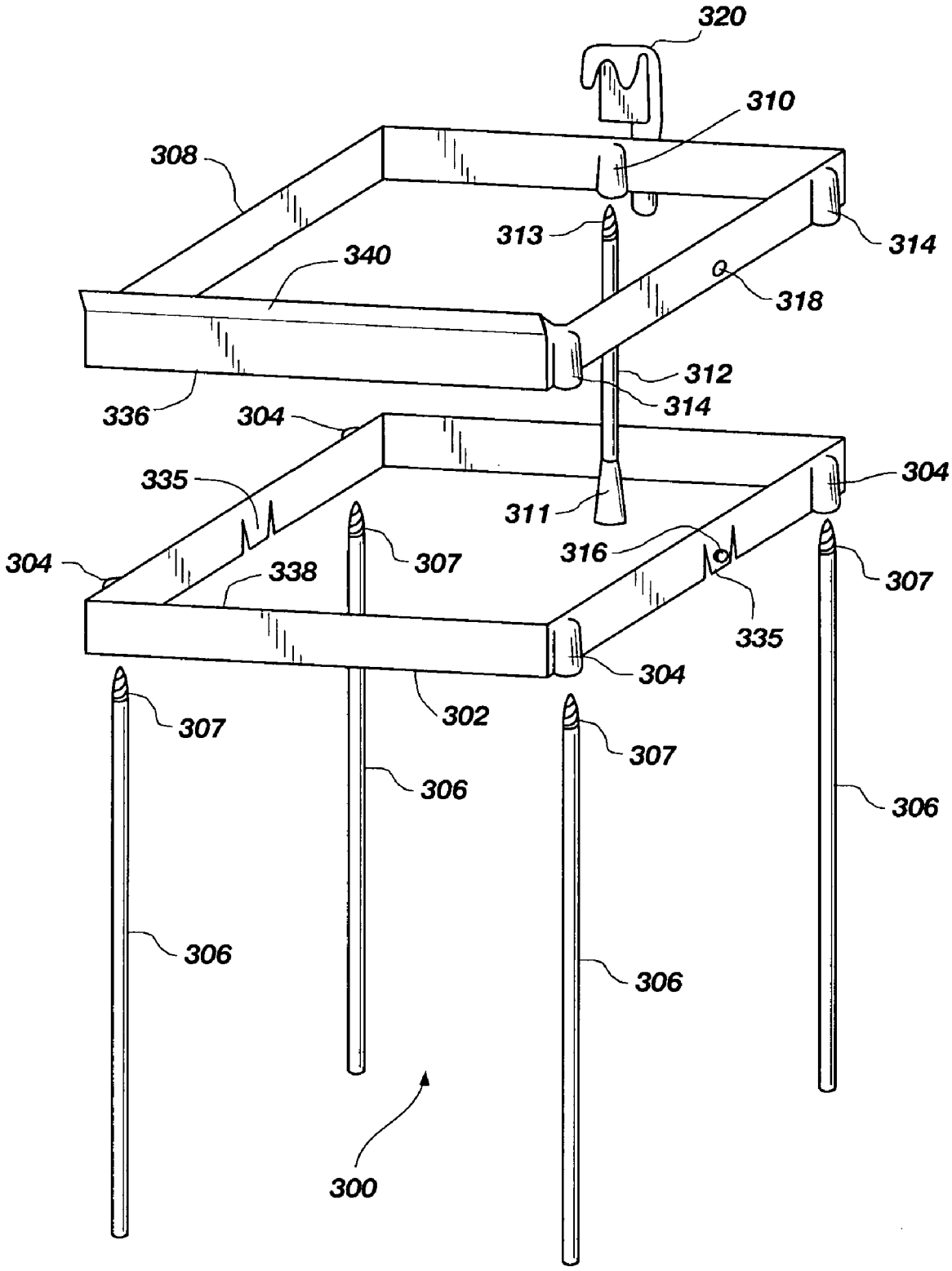
FIG. 19 shows a broken view of yet another embodiment of a bag support device.

Referring to FIG. 19, there is shown yet another embodiment of a bag support device 300. Again, functionally, it is very similar to those embodiments described above. The device 300 includes an inner ring 302 having leg sockets that are adapted to receive the top ends 307 of the legs 306. The outer ring 308 includes a support member socket 310 configured to receive the top end 313 of bag support member 312—which can also include a widened end 311.

This embodiment also includes convexities 314 that correspond to sockets 304. It likewise includes a locking mechanism having a locking flap 335, a release button 316, and a locking hole 318.

A handle 320 can also be included. This embodiment can also include a tapered edge 340 on the outer loop 308.

An illustrative operation of the invention is as follows: A user would place a bag 144 (e.g. a trash sack), through the inside of the inner loop 102, and fold the top edges of the bag 144 down over the outside of the inner loop 102. The outer loop 108 would then be placed over the top of the inner loop 102 and folded bag 144, and the two are mated together. The inner loop 102 and the folded portion of the bag 144 are pressed up into the space 142. The convexities 114 slide down over the top of the leg sockets 104 (with the folded portion of the bag 144, or some portion thereof, being between them). The support member 112 is thereby directed down into the bag 144 and helps holds it open.

As the hole 118 and the locking button 116 align, the button 116 will snap into the hole 118 locking the mated loops 102, 108 together. The loops 102, 108 can later be unlocked by simply pressing the locking button 116 and roughly simultaneously pulling the loops 102, 108 apart.

Once the bag 144 is secured in place, the user can carry the entire assembly around as needed. As noted above, the present device is useful for picnics, camping, yard work, etc.—really any situation where a lightweight, easily transported receptacle is needed. If the items to be placed in the receptacle are piled up, it can be tipped on its side, and the tapered edge 140 serves to direct the items into the bag 144.

It is understood that the above-described embodiments are only illustrative of the application of the basic principles of the present invention. Numerous modifications and alternative arrangements may be devised by those skilled in the art without departing from the spirit and scope of the present invention.

What is claimed is:

1. A bag support device comprising:

a) an inner ring;

b) an outer ring defining a space that is adapted to receive the inner ring, and wherein the inner ring further includes a locking button and the outer ring includes a corresponding locking hole;

c) one or more legs coupled to the inner ring; and d) a bag support member coupled to the outer ring wherein the one or more legs are coupled to the inner ring through one or more corresponding leg sockets, and the outer ring further includes one or more convexities corresponding to the leg sockets.

2. The device of claim 1, wherein the outer ring further comprises a tapered edge.

3. The device of claim 1, wherein the bag support member is coupled to the outer ring through a support member socket.

4. The device of claim 1, further including a handle coupled to the outer ring.

5. A bag support device comprising:

a) an inner ring, having:

i) a locking flap, with a locking button extending therefrom; and ii) one or more leg sockets;

b) an outer ring defining a space that is adapted to receive the inner ring, and having:

i) a locking hole, corresponding to the locking button;

ii) a tapered edge; and iii) one or more convexities, corresponding to the one or more leg sockets;

c) one or more legs coupled to the inner ring at the leg sockets;

d) a bag support member coupled to the outer ring through a support member socket; and e) a handle coupled to the outer ring.

6. The device of claim 5, wherein the ring is a substantially semi-circular shape.

7. The device of claim 5, wherein the ring is a substantially triangular shape.

8. The device of claim 5, wherein the ring is a substantially rectangular shape.

9. The device of claim 5, wherein the ring is a substantially square shape.

10. A bag support device comprising:

a) an inner ring;

one or more legs removably coupled to the inner ring, wherein the one or more legs are removably coupled to the inner ring through one or more corresponding leg sockets;

c) an outer ring defining a space that is adapted to receive the inner ring, wherein the outer ring further includes one or more convexities corresponding to the leg sockets; and d) a bag support member coupled to the outer ring.

11. The device of claim 10 wherein the inner ring further includes a locking button and the outer ring includes a corresponding locking hole.

12. The device of claim 10, wherein the outer ring further comprises a tapered edge.

13. The device of claim 10, wherein the bag support member is coupled to the outer ring through a support member socket.

14. The device of claim 10, further including a handle coupled to the outer ring.

* * * * *